US009902555B2

(12) United States Patent
Talon et al.

(10) Patent No.: US 9,902,555 B2
(45) Date of Patent: Feb. 27, 2018

(54) FOOD PREPARATION CAPSULE

(71) Applicant: NESTEC S.A., Vevey (CH)

(72) Inventors: Christian Talon, Vufflens-le-Chateau (CH); Christophe Sebastien Paul Heydel, Chez le Bart (CH); Nicolas Jean-Guy Bezet, Macon (FR)

(73) Assignee: Nestec S.A., Vevey (CH)

( * ) Notice: Subject to any disclaimer, the term of this patent is extended or adjusted under 35 U.S.C. 154(b) by 147 days.

(21) Appl. No.: 14/780,312

(22) PCT Filed: Apr. 10, 2014

(86) PCT No.: PCT/EP2014/057290
§ 371 (c)(1),
(2) Date: Sep. 25, 2015

(87) PCT Pub. No.: WO2014/167062
PCT Pub. Date: Oct. 16, 2014

(65) Prior Publication Data

US 2016/0052706 A1 Feb. 25, 2016

(30) Foreign Application Priority Data

Apr. 11, 2013 (EP) ..... 13163334

(51) Int. Cl.
*B65D 85/804* (2006.01)

(52) U.S. Cl.
CPC ..... *B65D 85/8043* (2013.01)

(58) Field of Classification Search
CPC ..... B65D 47/2068; B65D 47/2075; B65D 47/2093; B65D 85/8043; A47J 31/0668; A47J 31/0673; A47J 31/0678
See application file for complete search history.

(56) References Cited

U.S. PATENT DOCUMENTS 3,592,365 A * 7/1971 Schwartzman .... B65D 83/0055 222/209
2004/0050872 A1* 3/2004 Masuda ..... B65D 35/14 222/212

(Continued)

FOREIGN PATENT DOCUMENTS

WO 2008011913 1/2008
WO 2012034819 3/2012

*Primary Examiner* — Viren A Thakur
(74) *Attorney, Agent, or Firm* — K&L Gates LLP

(57) ABSTRACT

The present invention concerns a capsule (11) containing a beverage ingredient, adapted to be functionally inserted in a food preparation machine (1), said capsule comprising walls (12) that define a cavity wherein said beverage is prepared by mixing said ingredient with a fluid injected therein under pressure by said machine, said capsule further comprising a dispensing opening (13), and opening means that open upon effect of the rise of pressure within said cavity, characterized in that said opening means comprise a flow-conducting channel (14) able to connect the capsule cavity to the dispensing opening (13) and a spring-mounted piston plug (15) that is movable in said channel between: (i) a closed position where said cavity pressure is below a first predetermined pressure Pc, the piston spring (16) is at rest, and the piston plug (15) seals against a sealing portion (19) of the channel walls, (ii) a dispensing position where said cavity pressure is equal or superior to Pc, the piston spring (16) is elastically deformed and the piston plug (15) is moved away from the channel walls so that beverage can flow outside of said capsule through said channel (14).

15 Claims, 8 Drawing Sheets

(56) References Cited

U.S. PATENT DOCUMENTS

| | | | | |
|---|---|---|---|---|
| 2004/0228955 | A1* | 11/2004 | Denisart | B65D 85/8043 426/590 |
| 2007/0062375 | A1* | 3/2007 | Liverani | B65D 85/8043 99/279 |
| 2008/0028946 | A1 | 2/2008 | Kirschner et al. | |
| 2008/0063319 | A1* | 3/2008 | Kuge | B65D 47/123 383/33 |
| 2013/0071532 | A1* | 3/2013 | Pribus | A47J 31/46 426/431 |
| 2013/0298777 | A1* | 11/2013 | Vestreli | A47J 31/4457 99/285 |

* cited by examiner

FOOD PREPARATION CAPSULE

CROSS REFERENCE TO RELATED APPLICATIONS

The present application is a National Stage of International Application No. PCT/EP2014/057290, filed on Apr. 10, 2014, which claims priority to European Patent Application No. 13163334.9, filed on Apr. 11, 2013, the entire contents of which are being incorporated herein by reference.

FIELD OF THE INVENTION

The present invention concerns a capsule for use in a food or beverage preparation machine, more precisely, a capsule with anti-dripping properties.

BACKGROUND OF THE INVENTION

Beverage preparation machines are well known in the food science and consumer goods area. Such machines allow a consumer to prepare at home a given type of beverage, for instance a coffee-based beverage, e.g. an espresso or a brew-like coffee cup.

Today, most beverage preparation machines for in-home beverage preparation comprise a system made of a machine which can accommodate portioned ingredients for the preparation of the beverage. Such portions can be soft pods or pads, or sachets, but more and more systems use semi-rigid or rigid portions such as rigid pods or capsules. In the following, it will be considered that the beverage machine of the invention is a beverage preparation machine working with a rigid or semi-rigid capsule, such as for instance capsules, sachets, pods, pads.

The machine comprises a receptacle or cavity for accommodating said capsule and a fluid injection system for injecting a fluid, preferably water, under pressure into the capsule. Water injected under pressure in the capsule, for the preparation of a coffee beverage according to the present invention, is preferably hot, that is to say at a temperature above 70° C. However, in some particular instances, it might also be at ambient temperature, or even chilled. The pressure (relative to atmospheric pressure) inside the capsule chamber during extraction and/or dissolution of the capsule contents, until the capsule opens, increases up to typically about 1 to about 8 bar for dissolution products and about 2 to about 12 bar for extraction of roast and ground coffee. Such a preparation process differs a lot from the so-called "brewing" process of beverage preparation—particularly for tea and coffee, in that brewing involves a long time of infusion of the ingredient by a fluid (e.g. hot water), whereas the beverage preparation process allows a consumer to prepare a beverage, for instance coffee, within a few seconds.

The principle of extracting and/or dissolving the contents of a closed capsule under pressure is known, and consists typically of inserting the capsule in a receptacle or cavity of a machine, injecting a quantity of pressurized water into the capsule, generally after piercing a face of the capsule with a piercing injection element such as a fluid injection needle mounted on the machine, so as to create a pressurized environment inside the capsule either to extract the substance or dissolve it, and then release the extracted substance or the dissolved substance through the capsule. Capsules allowing the application of this principle have already been described for example in applicant's European patents n° EP 1472156 B1, and EP 1784344 B1.

Machines allowing the application of this principle have already been described for example in patents CH 605 293 and EP 242 556. According to these documents, the machine comprises a receptacle or cavity for the capsule and a perforation and injection element made in the form of a hollow needle comprising in its distal region one or more liquid injection orifices. The needle has a dual function in that it opens the top portion of the capsule on the one hand, and that it forms the water inlet channel into the capsule on the other hand.

The machine further comprises a fluid tank—in most cases this fluid is water—for storing the fluid that is used to dissolve and/or infuse and/or extract under pressure the ingredient(s) contained in the capsule. The machine comprises a heating element such as a boiler or a heat exchanger, which is able to warm up the water used therein to working temperatures (classically temperatures up to 80-90° C.). Finally, the machine comprises a pump element for circulating the water from the tank to the capsule, optionally though the heating element. The way the water circulates within the machine is e.g. selected via a selecting valve means, such as for instance a peristaltic valve of the type described in applicant's European patent EP 2162653 B1.

When the beverage to be prepared is coffee, one interesting way to prepare the coffee is to provide the consumer with a capsule containing roast and ground coffee powder, which is to be extracted with hot water injected therein.

In many instances, the machine comprises a capsule holder for holding a capsule, which is intended to be inserted in and removed from a corresponding cavity or receptacle of the machine. When a capsule holder is loaded with a capsule and inserted within the machine in a functional manner, the water injection means of the machine can fluidly connect to the capsule to inject water therein for a food preparation, as described above. A capsule holder was described for example in applicant's European patent EP 1967100 B1.

Capsules have been developed for such an application of food preparation, and in particular for beverage preparation, which are described and claimed in applicant's European patent EP 1784344 B1, or in European patent application EP 2062831.

In short, such capsules comprise typically:

- a hollow body and an injection wall which is impermeable to liquids and to air and which is attached to the body and adapted to be punctured by e.g. an injection needle of the machine,
- a chamber containing a bed of roast and ground coffee to be extracted, or a soluble ingredient or mix of soluble ingredients,
- an aluminium membrane disposed at the bottom end of the capsule, closing the capsule, for retaining the internal pressure in the chamber.

The aluminium membrane is designed for being pierced with piercing means that are either integral with the capsule, or located outside of said capsule, for example within a capsule holder of the machine.

The piercing means are adapted for piercing dispensing holes in the aluminium membrane when the internal pressure inside the chamber reaches a certain pre-determined value.

Also, optionally, the capsule can further comprise means configured to break the jet of fluid so as to reduce the speed of the jet of fluid injected into the capsule and distribute the fluid across the bed of substance at a reduced speed.

In some instances when the product to be prepared and dispensed is a beverage, and depending on several parameters like the viscosity of said beverage, its serving temperature, and the preparation pressure, some dripping can occur at the end of the dispensing phase. In such cases, after the machine pump has stopped, and after the beverage is dispensed from the capsule into the cup, some liquid remaining into the capsule can drip through the bottom opening of said capsule.

This is undesirable because it is messy and unclean if the consumer has already withdrawn the cup from under the machine, or when the consumer moves the used capsule to the dustbin, and also because, in case the cup is still placed under the machine, an additional volume of beverage is dispensed into the cup, which does not correspond to the serving size.

It is therefore an objective of the present invention to provide a capsule that obviates the drawbacks of the known capsules, and comprises a system to guarantee that no dripping occurs, whatever the conditions of preparation of dispensing of the beverage. More than that, it is an objective to provide a system that is not sensitive to the temperature and pressure difference between inside and outside of the capsule. The solution should also be food safe, and cheap to produce.

SUMMARY OF THE INVENTION

The invention concerns a capsule containing a beverage ingredient, adapted to be functionally inserted in a food preparation machine, said capsule comprising walls that define a cavity wherein said beverage is prepared by mixing said ingredient with a fluid injected therein under pressure by said machine, said capsule further comprising a dispensing opening, and opening means that open upon effect of the rise of pressure within said cavity, characterized in that said opening means comprise a rigid flow-conducting channel able to connect the capsule cavity to the dispensing opening and a spring-mounted rigid piston plug that is movable in said channel between:

(i) a closed position where said cavity pressure is below a first predetermined pressure $P_C$, the piston spring is at rest, and the piston plug seals against a sealing portion of the channel walls, (ii) a dispensing position where said cavity pressure is equal or superior to $P_C$, the piston spring is elastically deformed and the piston plug is moved away from the channel walls so that beverage can flow outside of said capsule through said channel.

As can be understood, $P_C$ is the limit pressure after which the capsule self opens to let the beverage flow out. $P_C$ is preferably comprised between 0.003 and 5 bar, more preferably between 0.1 and 3 bar and most preferably between 0.5 and 2 bar.

Interestingly, a spring-mounted piston has the advantage of being a purely mechanical element that is not sensitive to the beverage preparation conditions, such as for instance temperature and pressure. This is particularly important that even in the case of a high temperature of the beverage dispensed through the channel, the spring is reliable and its deformability is not impacted, unlike other valve solutions known in the art like rubber slit valves for instance. With such slit valves, temperature and pressure can impact on the geometry and deformation properties of the valve lips, and reclosability is not guaranteed for instance when dispensing pressure is high (between 3 and 15 bar) and temperature is above 60 to 70° C. Moreover known solutions such as flexible rubber or silicone slit valves are expensive, unlike the mechanical piston plug according to the present invention. Moreover, another advantage of the invention is that the more pressure, the wider the dispensing opening opens.

Importantly, by "spring-mounted piston plug", it is meant that the spring that actuates the piston plug can be an integral part of the whole piston, but it can also be an independent part by itself, or it can also be integrally formed with the capsule walls. Preferably however, the spring part is integrally made together with the piston plug, and then the whole piston (plug plus spring) is assembled to the capsule walls.

Said piston plug is preferably movable in translation along a vertical symmetry axis of said channel.

In a first embodiment of the invention, the spring comprises a plurality of deformable wave-shaped arms integrally formed with said plug, each arm having a longitudinal axis that is substantially parallel to the longitudinal axis of said plug.

In a second embodiment of the invention, the spring comprises a plurality of deformable curved arms extending outwardly from the piston plug.

Preferably in the latter embodiment of the invention, the spring further comprises a ring connected to the distal ends of said curved arms, said ring for connecting said piston plug and spring to the rest of the capsule in such a way that said plug and spring are movable relative to the capsule.

In any case, said spring can be elastically compressible, or extendible. In both possibilities, the spring is deformed elastically and resiliently when pressure inside the capsule cavity increases.

In a preferred embodiment of the invention, the capsule further comprises a pierceable wall sealed between said capsule cavity and said dispensing channel, and piercing means located within the cavity or outside said cavity, and adapted to pierce said pierceable wall upon effect of the rise of pressure within said cavity.

With such a pierceable wall and piercing means, the capsule opening is therefore structured in two separate steps. When the pressure inside the capsule cavity increases, the pierceable wall and the piercing means come into contact with one another so that the pierceable wall is pierced. Beverage prepared inside the capsule cavity flows under pressure towards the capsule dispensing channel which is closed by the piston plug. Once the fluid pressure applies onto the piston, the spring deforms and the piston plug is moved relative to the channel, so that a passage is created between the two, through which beverage can flow, outside of the capsule, through the dispensing channel and into a cup placed under the capsule.

In a first possible embodiment, the piercing means can be a plate having a surface covered with at least one piercing protrusion, said plate being an independent element from the rest of the capsule, and arranged therein. In this case, the spring-mounted piston plug can be functionally assembled within a flow-conducting channel of said piercing plate.

In a second alternative embodiment, the piercing means can be a plate having a surface covered with at least one piercing protrusion, said plate being an integrally formed with the rest of the capsule walls.

Advantageously, said piston plug and spring can be integrally moulded from a thermoplastic material such as, but not limited to polyethylene, polypropylene, polystyrene, polycarbonate, polyoxymethylene (POM), polyetheretheretone (PEEK), polybutyleneterephtalate (PBT), a polyamide with or without glass fibre reinforcement, polyethylene terephthalate (PET), or a combination thereof.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
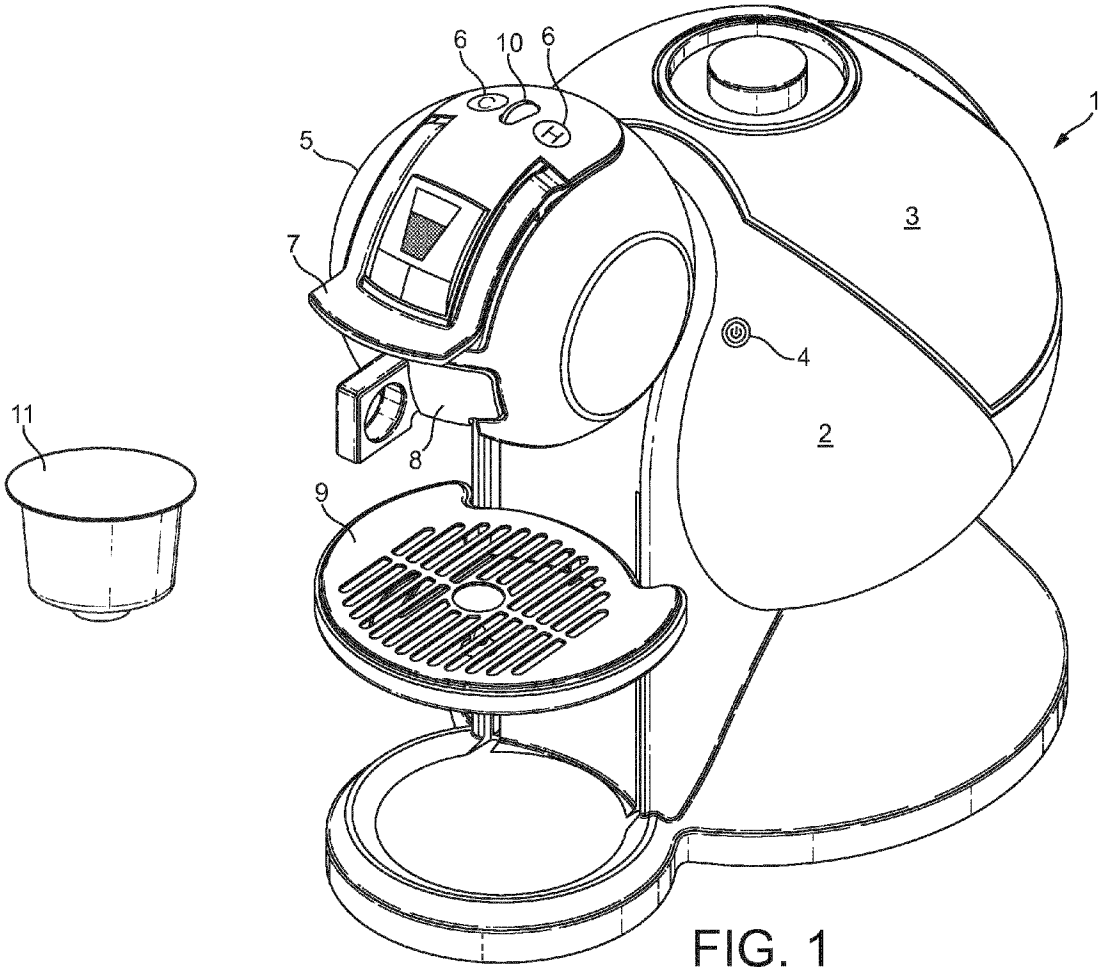
FIG. 1 is a schematic perspective view of a beverage preparation system.

The capsule according to the present invention is meant to be used with a beverage preparation machine illustrated in FIG. 1, thus forming a beverage preparation system.

As shown in FIG. 1, the machine 1 comprises a machine body 2, a water reservoir 3 that can be removed from the machine body 2 for refill. The body 2 comprises an on/off push button 4. The machine 1 further comprises an extraction head 5. The head 5 comprises a water temperature selector for hot or cold water taking the form of two buttons 6 (one for selecting a hot beverage, the other for cold), a locking lever 7, and an opening for insertion of a capsule holder 8. The machine 1 further comprises a cup tray 9, for holding a cup under the extraction head. The machine further comprises a control panel 10 comprising a selector wheel for selecting for instance the volume of beverage to be dispensed, as well as a screen, wherein data about the beverage preparation settings are represented. The capsule holder 8 is adapted to receive a capsule 11.

Figure 2:
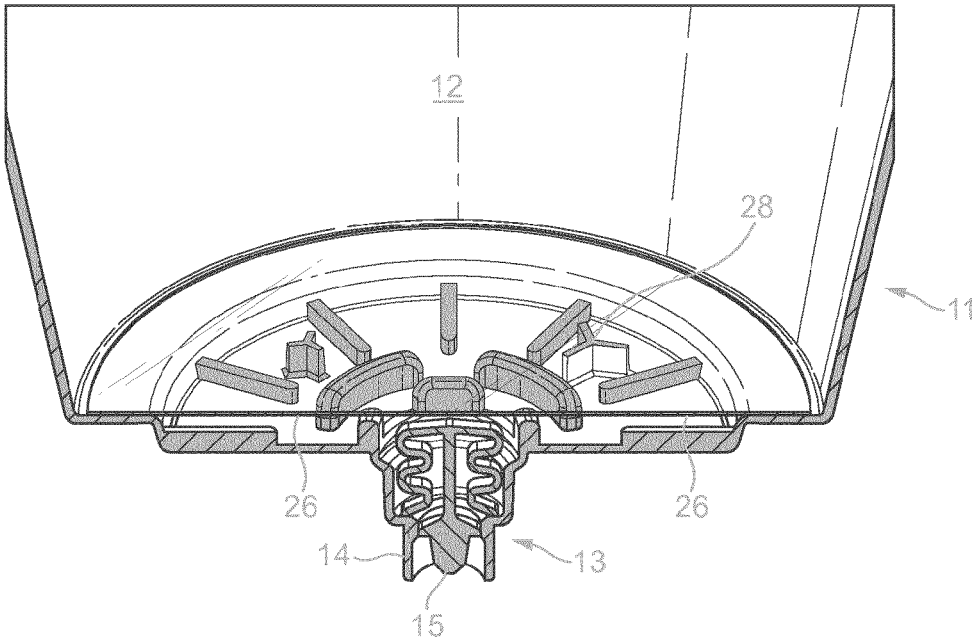
FIG. 2 is a schematic enlarged cut side view of the bottom part of a capsule according to the invention.
Figure 3:
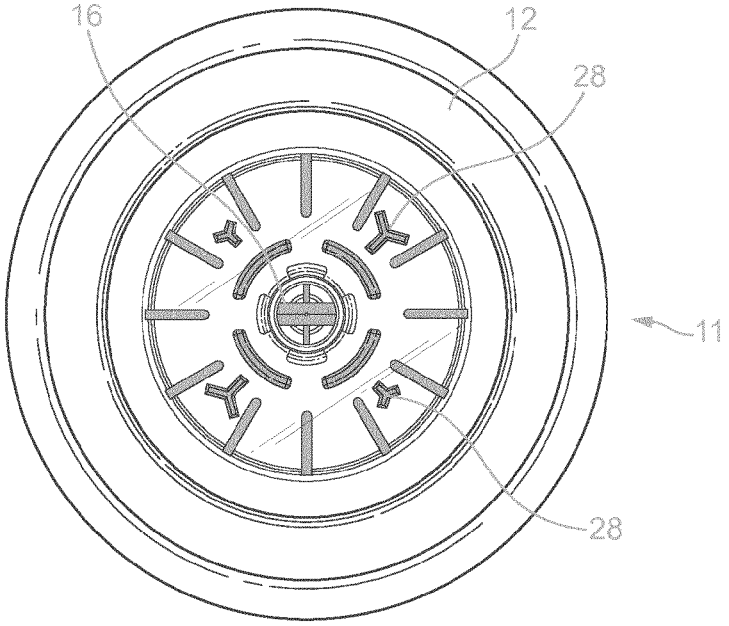
FIG. 3 is a top view similar to FIG. 2.

As illustrated in FIG. 2 and FIG. 3, the capsule 11 according to the present invention comprises capsule walls 12 that define a capsule cavity, into which a beverage ingredient is contained. This ingredient is in a form suitable for being mixed with water injected inside the capsule by the machine, under pressure. Typically, the ingredient is a powder; however, it can also be a liquid concentrate, a gel, a compacted powder (e.g. a tablet), or a mass of discrete elements such as small ingredient masses having a diameter less than 1 mm, that are either agglomerated or compacted.

The capsule further comprises a dispensing opening 13 with opening means that open upon effect of the rise of pressure within said cavity.

Figure 5:
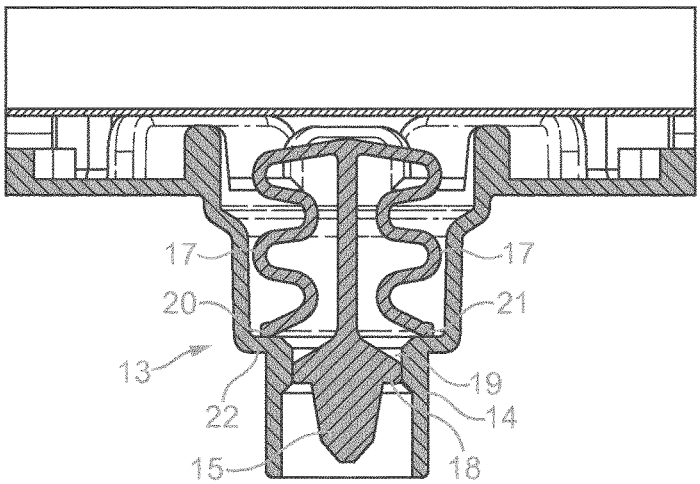
FIGS. 5, 6 and 7 are enlarged schematic cut views of a capsule dispensing opening with a piston valve according to the invention, in closed (FIG. 5) and open (FIGS. 6, 7) configurations.
Figure 6:
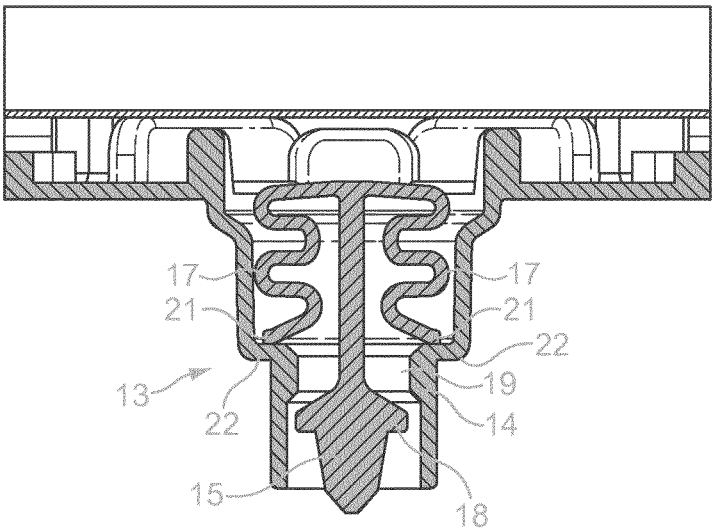
Figure 7:
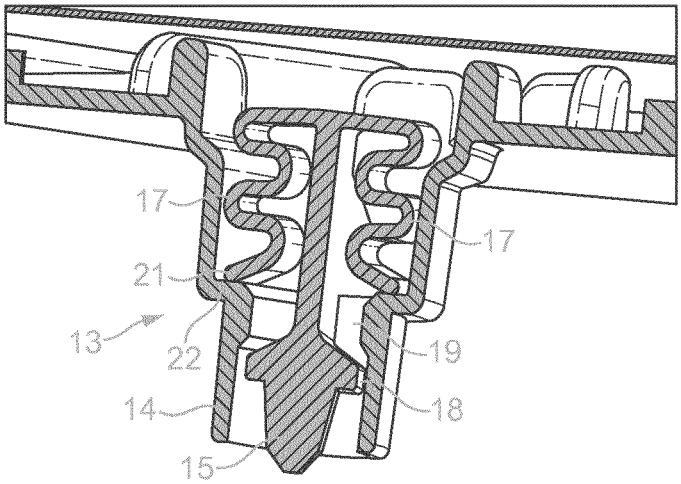
Figure 8:
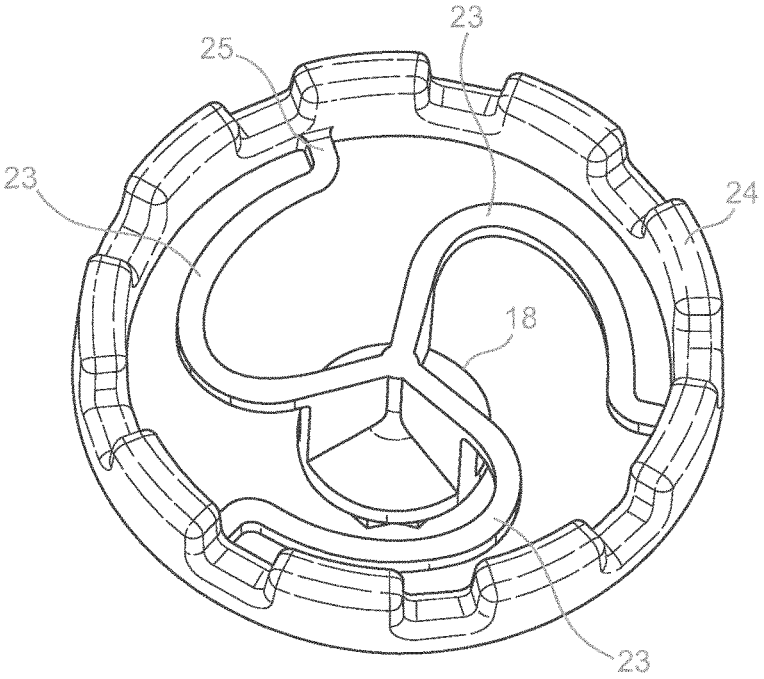
FIGS. 8 and 9 are schematic perspective top, respectively bottom, views of an alternative embodiment of a piston according to the invention.
Figure 9:
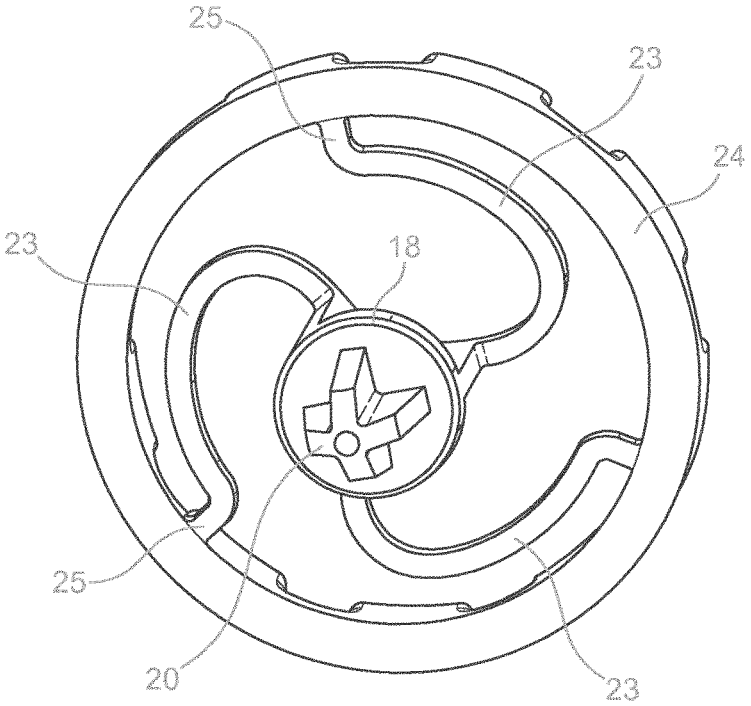

According to the essential principle of the invention, the opening means comprise a dispensing channel 14 and a spring-mounted piston plug 15 that is movable in said channel between:

(i) a closed position where said cavity pressure is below 1.2 bar, the piston spring is at rest, and the piston plug seals against the channel walls, as illustrated in FIGS. 2 and 5, (ii) a dispensing position where said cavity pressure is equal or above 1.2 bar, the piston spring is elastically deformed and the piston plug is moved away from the channel walls so that beverage can flow outside of said capsule through said dispensing channel, as illustrated in FIGS. 6 and 7.

The piston plug 15 is movable in translation within the channel 14, along the symmetry axis of said channel. The symmetry axis of said channel is not necessarily, although preferably vertical. The opening direction of the piston can be oriented downwardly as illustrated in the drawing, but can also be oriented in another direction, e.g. upside down.

In a first embodiment of the invention illustrated in FIGS. 2 to 7, the spring 16 comprises a pair of deformable wave-shaped spring arms 17. Said spring arms 17 are integrally formed by injection moulding together with the rest of the piston plug, and each of these arms 17 has a longitudinal axis that is substantially parallel to the longitudinal axis of said plug 15.

Figure 4:
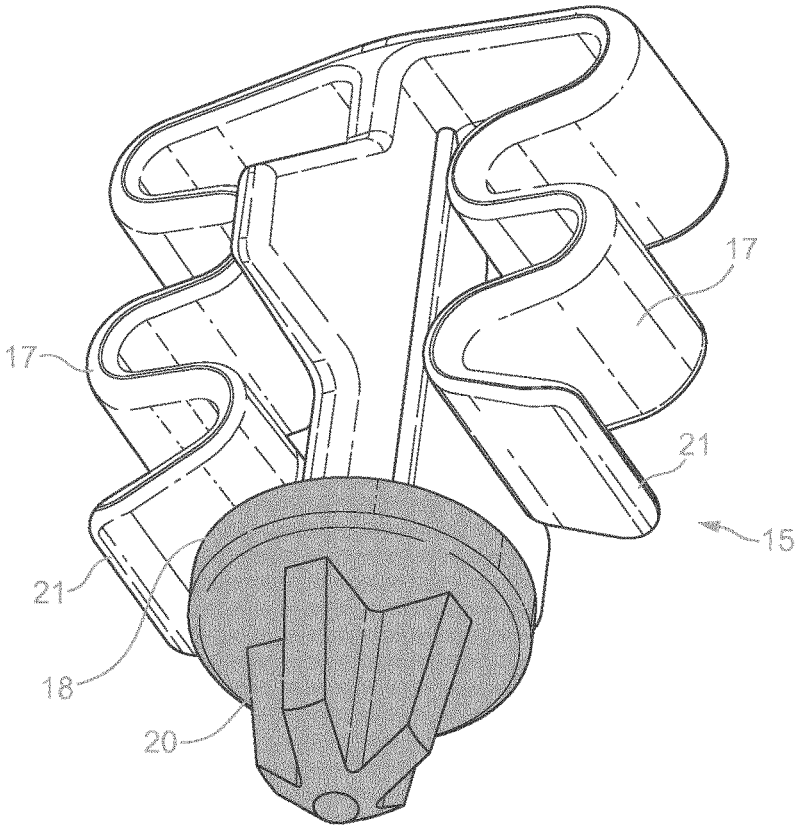
FIG. 4 is a schematic perspective bottom view of a piston valve according to the present invention.

As shown in greater detail in FIG. 4, the plug 15 comprises a sealing portion 18 which serves to seal against the inner surface of a corresponding sealing portion 19 of the dispensing channel 14, as illustrated in FIG. 5. The piston plug further comprises a flow-directing portion 20 which serves to direct the flow of beverage out of the capsule, towards the consumer cup, reducing spillage to a great extent. Preferably, the flow-directing portion 20 of the piston plug has a cross-shaped cross section, as illustrated in FIG. 4.

The distal free ends 21 of the arms 17 are meant to rest upon bearing edges 22 of the dispensing channel 14, as shown in FIGS. 5 to 7.

Once the capsule 11 is inserted within the machine and the consumer starts a beverage preparation cycle, water is injected within the capsule under pressure, to mix with the beverage ingredient contained therein. Fluid pressure inside the capsule cavity increases. As pressure builds-up, a force is exerted onto the upper surface of the piston sealing portion 18, which is forced downwards into the dispensing channel 14, while the spring arms 17 are squeezed, as illustrated in FIGS. 6 and 7. When the sliding movement of the piston 15 is sufficient, the sealing portion 18 escapes the sealing portion 19 of the dispensing channel as illustrated in FIGS. 6 and 7, thus creating a passage for the flow of beverage that is directed towards a cup placed below (not shown in the drawing).

Once, the beverage preparation is complete, the machine stops injecting water within the capsule, and as beverage is dispensed, in-capsule pressure decreases until it has reached a limit pressure below which the spring 16 moves back the piston plug 15 back into its initial rest position. In this rest position, the piston sealing portion 18 is adjacent to the sealing portion 19 of the dispensing channel as shown in FIG. 5, and the latter is closed. In case some liquid remains within the capsule, it is retained within the capsule, and no dripping occurs.

In addition, the applicant surprisingly observed that when the piston has returned to its closed position after the capsule has been used, no spillage can occur through the opening pierced by the water injection needle of the machine through the top wall of the capsule.

In a second embodiment of the invention illustrated in FIGS. 8 to 12, the spring 16 comprises three deformable curved arms 23 extending outwardly from the piston plug 15. The spring further comprises a ring 24 connected to the distal ends 25 of said curved arms 23. The ring 24 serves for connecting said piston plug 15 and spring 16 to the rest of the capsule in such a way that said plug and spring are movable relative to the capsule.

Figure 12:
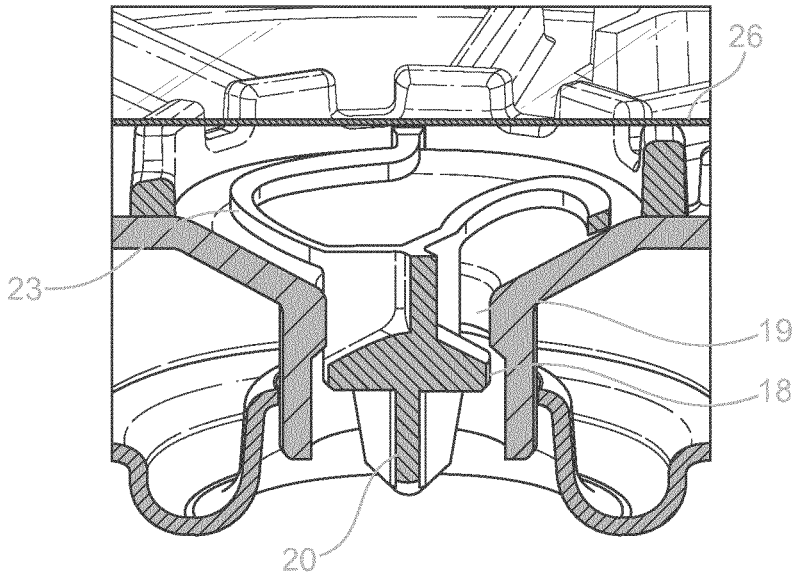

The function of this spring embodiment is similar to that of the first embodiment described above. Again, once the capsule 11 is inserted within the machine and the consumer starts a beverage preparation cycle, water is injected within the capsule under pressure, to mix with the beverage ingredient contained therein. Fluid pressure inside the capsule cavity increases. As pressure builds-up, a force is exerted onto the upper surface of the piston sealing portion 18, which is forced downwards into the dispensing channel 14, while the spring arms 17 are deformed, as illustrated in FIG. 12. When the sliding movement of the piston 15 is sufficient, the sealing portion 18 escapes the sealing portion 19 of the dispensing channel as illustrated in FIG. 12, thus creating a passage for the flow of beverage that is directed towards a cup placed below (not shown in the drawing).

Figure 11:
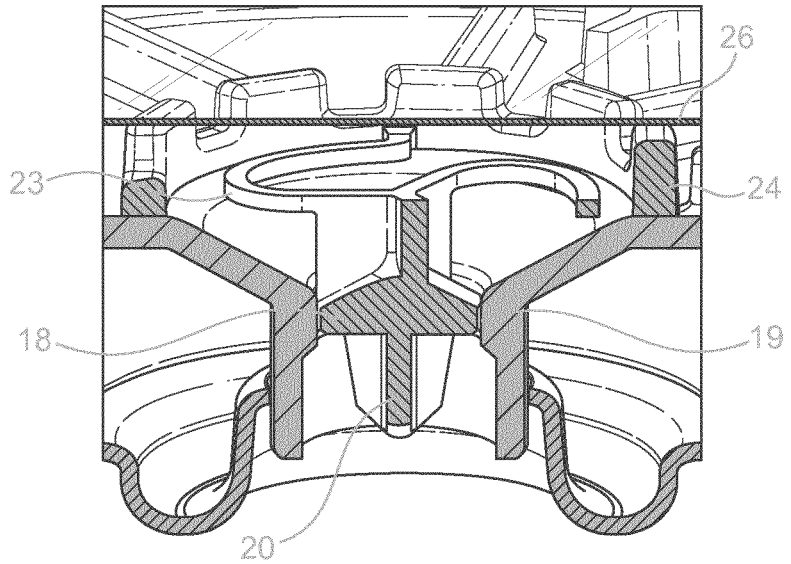
FIGS. 11 and 12 are enlarged schematic cut views of a capsule dispensing opening with a piston valve according to the alternative embodiment illustrated in FIGS. 8, 9, and 10, in closed, respectively open, configurations.

Once, the beverage preparation is complete, the machine stops injecting water within the capsule, and as beverage is dispensed, in-capsule pressure decreases until it has reached a limit pressure below which the spring 16 moves back the piston plug 15 back into its initial rest position illustrated in FIG. 11. In this rest position, the piston sealing portion 18 is adjacent to the sealing portion 19 of the dispensing channel as shown in FIG. 11, and the latter is closed. In case some liquid remains within the capsule, it is retained within the capsule, and no dripping occurs.

Figure 10:
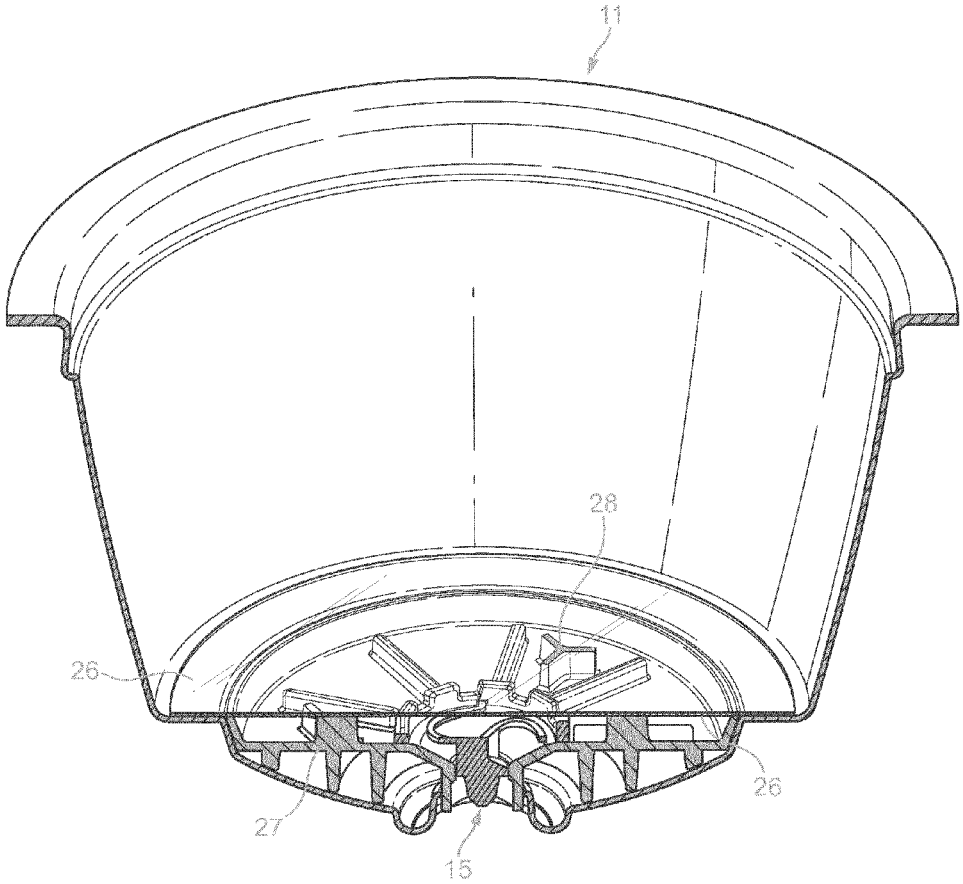
FIG. 10 is a schematic cut side view of a capsule featuring a piston valve according to the alternative embodiment illustrated in FIGS. 8 and 9.

As represented in FIGS. 2 and 10, the capsule can further comprise a pierceable wall 26 sealed between said capsule cavity and said dispensing channel, and piercing means 27 located within the cavity or outside said cavity, and adapted to pierce said pierceable wall upon effect of the rise of pressure within said cavity. Said piercing means is a plate having a surface covered with at least one piercing protrusion 28.

In a first embodiment of the invention, as illustrated in FIG. 2, said plate is integrally moulded together with the rest of the capsule.

In a second alternative embodiment of the invention, the piercing plate is a separate element from the rest of the capsule, and is assembled therein, as illustrated in FIG. 10.

Importantly though, the fact that the piercing plate is integral or separate from the rest of the capsule is independent from the type of spring that is used with the piston plug. All combinations of these elements can be produced, with somehow equivalent technical effects.

Figure 13:
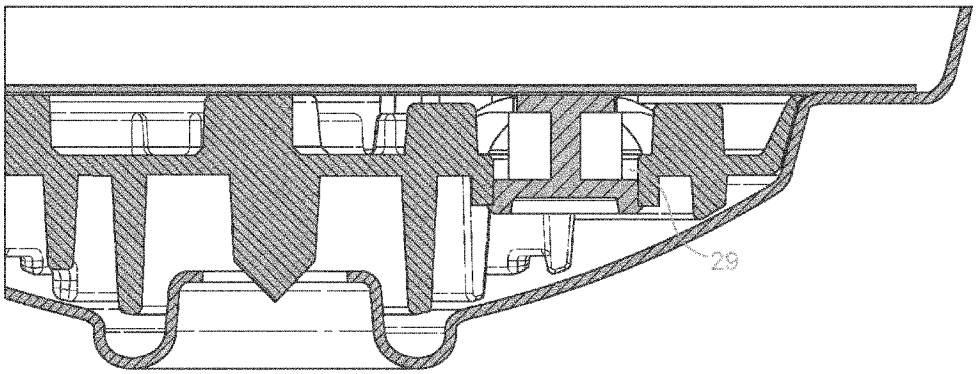
FIGS. 13 and 14 are partial schematic cut views of yet another embodiment of the invention where the piston valve is assembled with an additional opening means of the capsule.
Figure 14:
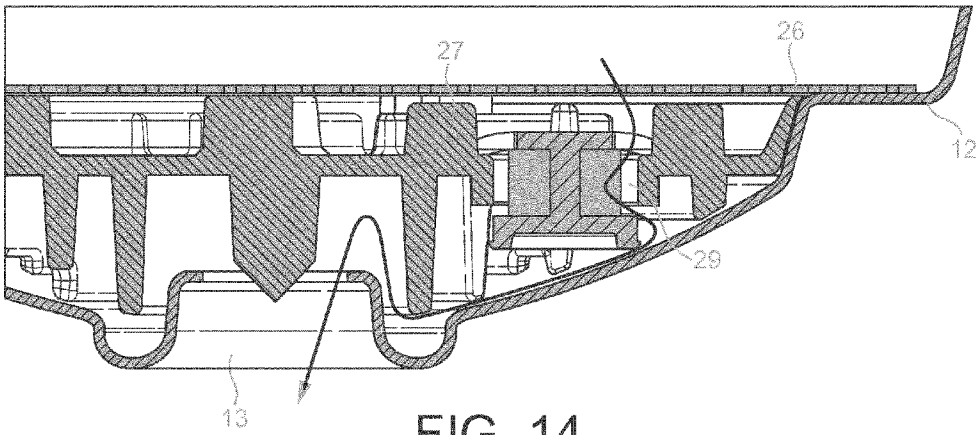

In case the piercing plate is a separate element of the capsule as described above and shown in FIG. 10, the piston plug and spring can be assembled directly to the piercing plate, as shown in FIG. 13. In this case, the spring-mounted piston plug 15 is functionally assembled within a flow-conducting channel 29 of said piercing plate 27. As described above, when pressure builds-up inside the capsule, the piston plug 15 is pressed downwards and a flow path opens as illustrated with an arrow in FIG. 14. When the pressure inside the capsule decreases, the piston plug comes back into its closed position shown in FIG. 13. As can be understood, in this case, two different opening systems are combined. The first one is made of the pierceable membrane and piercing plate, which is a permanent opening system: once opened, the pierced membrane cannot reseal, however, the membrane guarantees a perfect seal during storage and shelf life of the capsule. The second one is the reclosable spring-mounted piston plug system according to the present invention.

The fact that the present invention solves the technical problem of dripping, is due to the sealing effect of the piston plug with the capsule wall surface onto which it rests when said piston is in the closed position. The sealing effect of the piston plug on the capsule walls (or dispensing channel walls) can be achieved either with:

capillarity effect: in this case, a functional play exists between the piston plug and the capsule walls in the closed position of the piston (which is typically about 10 to 300 microns), so that the plug can move relatively to the capsule, the distance between the two being sufficient small to allow the creation of a capillarity effect to prevent liquids to flow there between, or active sealing which is achieved by direct contact of the plug and the capsule through a surface made of a sealing material, for instance rubber, on the capsule and/or on the piston plug.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule containing a beverage ingredient, adapted to be functionally inserted in a food preparation machine, the capsule comprising walls that define a cavity wherein a beverage is prepared by mixing the beverage ingredient with a fluid injected in the cavity under a pressure by the food preparation machine, the capsule further comprising a dispensing opening, and a flow-conducting channel that opens upon an increase of the pressure within the cavity, the flow-conducting channel able to connect the cavity to the dispensing opening and a piston plug that is mounted with a spring and movable in the flow-conducting channel between:

a closed position where the pressure within the cavity is below a first predetermined pressure $P_C$, the spring is at rest, and the piston plug seals against a sealing portion of channel walls of the flow-conducting channel; and a dispensing position where the pressure within the cavity is equal to or greater than $P_C$, the spring is elastically deformed and the piston plug is moved away from the channel walls of the flow-conducting channel, so that the beverage can flow outside of the capsule through the flow-conducting channel; and the capsule further comprising a pierceable wall sealed between the cavity and the dispensing opening, and a piercing member located within the cavity or outside the cavity and adapted to pierce the pierceable wall upon the increase of the pressure within the cavity, the piercing member is a plate having a surface comprising at least one piercing protrusion, the flow-conducting channel is within the plate, and the piston plug is connected to the plate and positioned within the flow-conducting channel, the capsule comprising the piston plug.

2. The capsule according to claim 1, wherein $P_C$ is between 0.003 and 5 bar.

3. The capsule according to claim 1, wherein the piston plug is movable in translation along a vertical symmetry axis of the flow-conducting channel.

4. The capsule according to claim 1, wherein the spring comprises a plurality of deformable wave-shaped arms integrally formed with the piston plug, each arm having a longitudinal axis that is substantially parallel to a longitudinal axis of the piston plug.

5. The capsule according to claim 1, wherein the spring comprises a plurality of deformable curved arms extending outwardly from the piston plug.

6. The capsule according to claim 5, wherein the spring comprises a ring connected to distal ends of the plurality of deformable curved arms, the ring connecting the piston plug and the spring to the rest of the capsule.

7. The capsule according to claim 1, wherein the spring is elastically compressible.

8. The capsule according to claim 1, wherein the spring is elastically extendible.

9. The capsule according to claim 1, wherein the plate is an independent element from the rest of the capsule and arranged in the capsule.

10. The capsule according to claim 1, wherein the plate is an integrally formed with the rest of the walls of the capsule.

11. The capsule according to claim 1, wherein the piston plug comprises a sealing portion and a flow-directing portion.

12. The capsule according to claim 1, wherein the piston plug and the spring are integrally molded from a thermoplastic material.

13. The capsule according to claim 6, wherein the ring is configured to connect the piston plug and the spring to the rest of the capsule such that the piston plug and the spring are movable relative to the capsule.

14. The capsule according to claim 1, wherein in the closed position of the piston plug, a distance between the piston plug and the walls of the flow-conducting channel is about 10 to 300 microns.

15. The capsule according to claim 1, wherein a distance between the piston plug and the walls of the flow-conducting channel in the closed position of the piston plug allows creation of a capillarity effect to prevent liquids from flowing between the piston plug and the walls of the capsule.

* * * * *